US011248609B2

(12) United States Patent
Hu et al.

(10) Patent No.: US 11,248,609 B2
(45) Date of Patent: Feb. 15, 2022

(54) OIL LINE STRUCTURE OF COMPRESSOR AND COMPRESSOR

(71) Applicants: Gree Electric Appliances (Wuhan) Co., Ltd, Wuhan (CN); Gree Electric Appliances, Inc. of Zhuhai, Zhuhai (CN)

(72) Inventors: Yusheng Hu, Zhuhai (CN); Jia Xu, Zhuhai (CN); Zhenjiang Zhang, Zhuhai (CN); Guomang Yang, Zhuhai (CN); Pengkai Wan, Zhuhai (CN); Shebing Liang, Zhuhai (CN)

(73) Assignees: Gree Electric Appliances (Wuhan) Co., Ltd, Wuhan (CN); Gree Electric Appliances, Inc. of Zhuhai, Zhuhai (CN)

( * ) Notice: Subject to any disclaimer, the term of this patent is extended or adjusted under 35 U.S.C. 154(b) by 115 days.

(21) Appl. No.: 16/617,033

(22) PCT Filed: Dec. 25, 2017

(86) PCT No.: PCT/CN2017/118247

§ 371 (c)(1),
(2) Date: Nov. 26, 2019

(87) PCT Pub. No.: WO2019/061892

PCT Pub. Date: Apr. 4, 2019

(65) Prior Publication Data

US 2021/0131437 A1 May 6, 2021

(30) Foreign Application Priority Data

Sep. 29, 2017 (CN) ..... 201710907160.8

(51) Int. Cl.
*F04C 29/02* (2006.01)
*F04C 18/344* (2006.01)

(52) U.S. Cl.
CPC ..... *F04C 29/028* (2013.01); *F04C 18/344* (2013.01); *F04C 29/02* (2013.01); *F04C 29/023* (2013.01); *F04C 2240/50* (2013.01)

(58) Field of Classification Search
CPC ..... F04C 29/02; F04C 29/023; F04C 29/028; F04C 2240/50; F04C 18/344
See application file for complete search history.

(56) References Cited

U.S. PATENT DOCUMENTS 2,737,341 A * 3/1956 Bitzer ..... B60S 1/12 417/364
2017/0342982 A1* 11/2017 Wan ..... F04C 18/344

FOREIGN PATENT DOCUMENTS

CN 101265893 A 9/2008
CN 203404081 U 1/2014
(Continued)

*Primary Examiner* — Mark A Laurenzi
*Assistant Examiner* — Xiaoting Hu
(74) *Attorney, Agent, or Firm* — The Webb Law Firm

(57) ABSTRACT

The present disclosure relates to an oil line structure of a compressor and compressor, wherein the oil line structure of a compressor including: a spindle, an upper flange and a rolling bearing, wherein an interior of the rolling bearing encloses a cylinder cavity for performing compression, and the rolling bearing comprises a rolling body; wherein the spindle is internally provided with a spindle oil hole, and the upper flange is provided with an upper oil groove which is in communication with the spindle oil hole to guide an oil into the rolling body so as to lubricate the same. In this way, the heat generated by friction of the rolling body is discharged in time, so as to prevent a temperature rise in the bearing and reduce the wear, thereby improving the energy efficiency value of the compressor and ensuring normal operation of the compressor.

15 Claims, 7 Drawing Sheets

(56) References Cited

FOREIGN PATENT DOCUMENTS

| | | | | | |
|---|---|---|---|---|---|
| CN | 204239241 | U | * | 4/2015 | |
| CN | 204239241 | U | | 4/2015 | |
| CN | 204572458 | U | | 8/2015 | |
| CN | 105952642 | A | * | 9/2016 | |
| CN | 105952642 | A | | 9/2016 | |
| CN | 205677829 | U | | 11/2016 | |
| CN | 207363876 | U | | 5/2018 | |
| CN | 106481555 | B | | 9/2018 | |
| EP | 2520802 | A1 | | 11/2012 | |
| JP | 2000337281 | A | | 12/2000 | |
| KR | 1020120021573 | A | | 3/2012 | |
| WO | WO-2016119456 | A1 | * | 8/2016 | ..... F04C 18/344 |

* cited by examiner

OIL LINE STRUCTURE OF COMPRESSOR AND COMPRESSOR

CROSS-REFERENCE TO RELATED APPLICATIONS

This application is the United States national phase of International Application No. PCT/CN2017/118247 filed Dec. 25, 2017, and claims priority to Chinese Patent Application No. 201710907160.8 filed Sep. 29, 2017, the disclosures of which are hereby incorporated by reference in their entirety.

BACKGROUND OF THE INVENTION

Field of the Invention

The present disclosure pertains to the technical field of a compressor, and in particular to a compressor and an oil line structure thereof.

Description of Related Art

The suction and exhaust structure of the relevant rotary vane compressor is mainly arranged on a lateral surface of the cylinder. However, due to a serious wear of the slider head and the inner wall of the cylinder, it causes a great mechanical power consumption of the compressor, so that there is a poor overall energy efficiency, even leading to the problems concerning the reliability such as abnormal wear when it is severe.

Korean Patent Application No. KR1020100076562 discloses a rolling bearing solution: the structures of a rolling body and a cone (similar to a roller) are added in the inner wall of the cylinder, to ensure that the sliding of the slider head relative to the inner wall of the cone is converted into the rolling motion of the cone and the rolling body, thereby reducing the mechanical power consumption of the compressor and improving the energy efficiency of the compressor.

However, the disclosed structure does not lubricate the rolling bearing. During the operation of the compressor, the heat generated by the friction of the rolling body is not discharged in time, which is to result in that the temperature rise at the site leads to the problems concerning the reliability of the rolling bearing during long-term operation. At the same time, an excessive temperature results in a severe heating of the wall (the heating of the refrigerant during the compression deviates more from the adiabatic compression, so that the power consumption is increased) during the compression, thereby leading to a poorer compression function. Further, since there is no lubricant oil to lubricate the rolling body of the rolling bearing during the operation, it is to produce a dry friction metal contact to lead to adhesive wear or the like, and further lead to the abnormality of the entire compressor.

Since the relevant rotary vane compressor does not lubricate the rolling bearing, during the operation of the compressor, the heat generated by the friction of the rolling body is not discharged in time, which is likely to result in that the temperature rise at the site leads to the problems concerning the reliability of the rolling bearing during long-term operation, and there is a poorer compression function. Therefore, after study, the present disclosure designs a compressor and an oil line structure thereof.

SUMMARY OF THE INVENTION

Therefore, the technical problem to be solved by the present disclosure is to overcome the defect as present in the relevant compressor that the heat generated by friction of the rolling body is not discharged in time, thereby providing a compressor and an oil line structure thereof.

The present disclosure provides an oil line structure of a compressor, which includes:

a spindle, an upper flange and a rolling bearing, wherein an interior of the rolling bearing encloses a cylinder cavity for performing compression, and the rolling bearing includes a rolling body;

wherein the spindle is internally provided with a spindle oil hole, and the upper flange is provided with an upper oil groove which is in communication with the spindle oil hole to guide an oil into the rolling body so as to lubricate the same.

In some embodiments, wherein the upper oil groove includes:

a straight oil groove in communication with the spindle oil hole;

an oil inlet hole in communication with the rolling body;

an oil inlet passage with one end in communication with the straight oil groove and the other end in communication with the oil inlet hole.

In some embodiments, wherein the straight oil groove is provided on a radially inner side of the upper flange and extends along an axial direction of the upper flange; the oil inlet passage extends along a radial direction of the upper flange, and the oil inlet hole extends along the axial direction of the upper flange.

In some embodiments, wherein in a cross section of the upper flange, the straight oil groove is an annular oil groove or an arc-shaped oil groove.

In some embodiments, wherein two or more oil inlet passages are arranged along a circumference of the upper flange;

each of the oil inlet passages is in communication with respective one of the oil inlet holes respectively, and two or more of the oil inlet passages are in communication with one of the straight oil grooves, or each of the oil inlet passages is in communication with respective one of the straight oil grooves respectively.

In some embodiments, further including an upper oil reservoir disposed on the upper flange, wherein the upper oil reservoir communicates with the oil inlet hole and the oil inlet passage.

In some embodiments, wherein the upper oil reservoir is located above an axial direction of the oil inlet hole and extends in a circumferential direction of the upper flange.

In some embodiments, wherein a gasket is provided between the upper flange and the rolling bearing, and along an axial direction of the spindle, the gasket is provided with a plurality of oil guiding holes, the plurality of oil guiding holes are arranged along a circumferential direction of the spindle, and communicate the oil inlet hole with the rolling body.

In some embodiments, wherein at least two of the plurality of oil guiding holes have different diameters, and the oil guiding hole closer to the exhaust hole of the rolling bearing has a larger diameter than the oil guiding hole closer to the intake hole of the rolling bearing.

In some embodiments, further includes a lower flange, the lower flange is provided with a lower oil groove in communication with the rolling body, the lower oil groove is configured to guide the oil out of the lower flange or guide the oil out of the rolling bearing.

In some embodiments, wherein the lower oil groove is located below an axial direction of the rolling body, and the lower oil groove radially extends to a circumferential end surface of the lower flange, so as to guide the oil out of the circumferential end surface.

In some embodiments, wherein two or more the lower oil grooves are arranged at different circumferential positions of the lower flange.

In some embodiments, further includes a lower oil reservoir provided in the lower flange, wherein the lower oil reservoir is in communication with the lower oil groove.

In some embodiments, wherein the lower oil reservoir is an annular structure circumferentially surrounding the spindle.

In some embodiments, wherein the rolling bearing includes a bearing cone and a bearing cup, the bearing cup is provided with a bearing cup oil groove, and the lower oil groove communicates the rolling body with the bearing cup oil groove to discharge the oil from the bearing cup through the bearing cup oil groove.

In some embodiments, wherein the bearing cup oil groove includes an axial oil hole extending along the axial direction of the bearing cup and at least one radial oil hole extending along the radial direction of the bearing cup, the axial oil hole communicates with the lower oil groove, and the radial oil hole communicates with the axial oil hole, such that the oil is discharged from a circumferential surface of the bearing cup through the radial oil hole.

In some embodiments, wherein the lower oil groove extends along a radial direction of the lower flange;

and/or, there are a plurality of the radial oil holes arranged in parallel, and extending along a radial direction of the bearing cup.

In some embodiments, wherein the spindle oil hole includes a spindle radial oil hole provided inside the spindle and along a radial direction of the spindle.

The present disclosure provides a compressor, including the oil line structure of a compressor.

In some embodiments, wherein the compressor is a rotary vane compressor.

The present disclosure provides an air-conditioner, including the oil line structure of a compressor.

The compressor and the oil line structure thereof provided by the present disclosure at least have the following advantageous effects:

1. In some embodiments of the compressor and the oil passage structure thereof according to the present disclosure, the upper flange is provided with an upper oil groove in communication with the spindle oil hole for guiding the oil into the rolling body to lubricate the same. The upper oil groove is configured to effectively guide the oil in the spindle oil hole of the compressor into a site of the rolling body of the rolling bearing through the upper flange, and lubricate and cool the same. In this way, the heat generated by friction of the rolling body is discharged in time, so as to prevent a temperature rise in the bearing and reduce the wear, thereby improving the energy efficiency value of the compressor and ensuring normal operation of the compressor.

2. In some embodiments of the compressor and the oil line structure thereof according to the present disclosure, by the upper oil groove provided in the upper flange, the oil is guided from top to bottom into the rolling body of the rolling bearing by gravity, thereby achieving sufficient lubricating oil providing to the rolling bearing and normal operation of the compressor.

3. In some embodiments of the compressor and the oil line structure thereof according to the present disclosure, by means of the upper oil reservoir provided at the upper flange, the oil in the oil inlet passage is guided into the upper oil reservoir for storage before guiding into the oil inlet passage, thereby achieving the oil storage effect during an excessively large amount of oil, and releasing the lubricating oil through the oil reservoir during an excessively small amount of oil, to achieve a favorable lubricating and cooling effect of the rolling bearing and improve the performance of the compressor. By the lower oil groove provided in the lower flange, it is possible to store the oil, and at the same time, it is also possible to discharge the lubricating oil into the housing of the compressor through the lower oil groove to realize the recovery and recycling of the oil.

Figure 1:
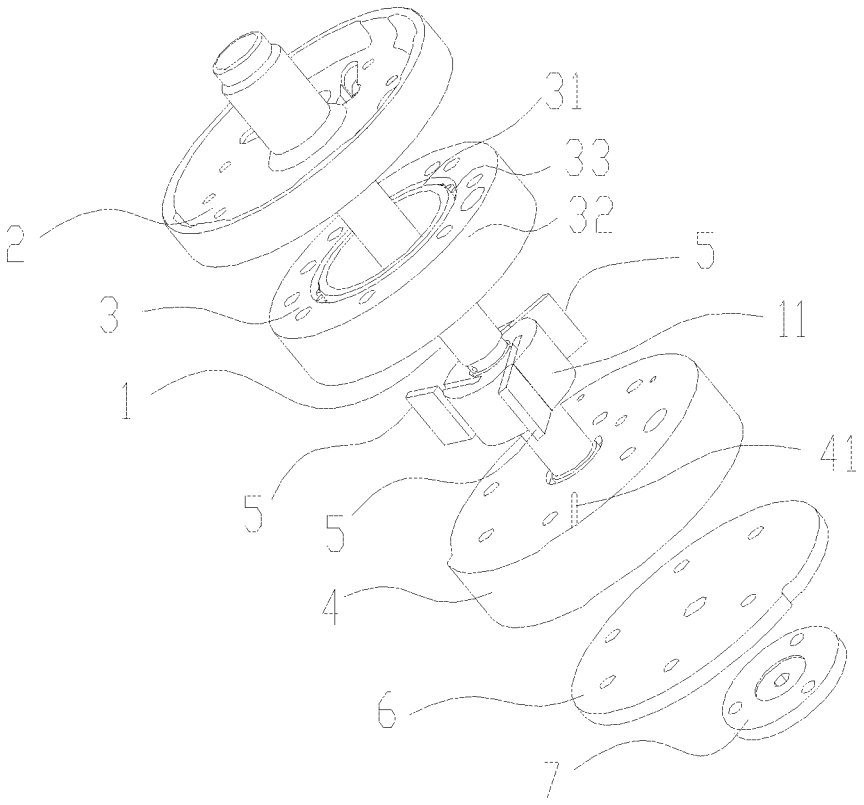
FIG. 1 shows an exploded perspective view of a pump structure of a compressor according to some embodiments of the present disclosure.

The reference signs in the drawings are presented as follows:

1. spindle; 10. spindle oil hole; 11. spindle center portion; 12. spindle escape; 13. spindle radial oil hole; 2. upper flange; 20. upper oil groove; 20*a*. straight oil groove; 20*b*. oil inlet passage; 20*c*. oil inlet hole; 21. upper oil reservoir; 3. rolling bearing (cylinder); 31. bearing cone; 32. bearing cup; 321. bearing cup oil groove; 321*a*. axial oil hole; 321*b*. radial oil hole; 33. rolling body; 4. lower flange; 41. lower oil groove; 42. lower oil reservoir; 5. vane; 6. lower cover plate; 7. gear oil pump; 8. gasket; 81. oil guiding hole.

DESCRIPTION OF THE INVENTION

As shown in FIG. 1, the present disclosure provides an oil line structure of a compressor, which includes:

a spindle 1, an upper flange 2 and a rolling bearing 3, wherein an interior of the rolling bearing 3 (cylinder) encloses a cylinder cavity for performing compression, and the rolling bearing 3 includes a rolling body 33;

wherein, the spindle 1 is internally provided with a spindle oil hole 10, and the upper flange 2 is provided with an upper oil groove 20, the upper oil groove 20 is in communication with the spindle oil hole 10 for guiding an oil into the rolling body 33 so as to lubricate the same.

The upper flange is provided with an upper oil groove in communication with the spindle oil hole for guiding the oil into the rolling body to lubricate the same. The upper oil groove is configured to effectively guide the oil in the spindle oil hole of the compressor into a site of the rolling body of the rolling bearing through the upper flange, and lubricate and cool the same. In this way, the heat generated by friction of the rolling body is discharged in time, so as to prevent a temperature rise in the bearing and reduce the wear, thereby improving the energy efficiency value of the compressor and ensuring normal operation of the compressor.

And the oil is guided from top to bottom into the rolling body of the rolling bearing by gravity, thereby achieving sufficient lubricating oil providing to the rolling bearing and normal operation of the compressor.

Figure 2:
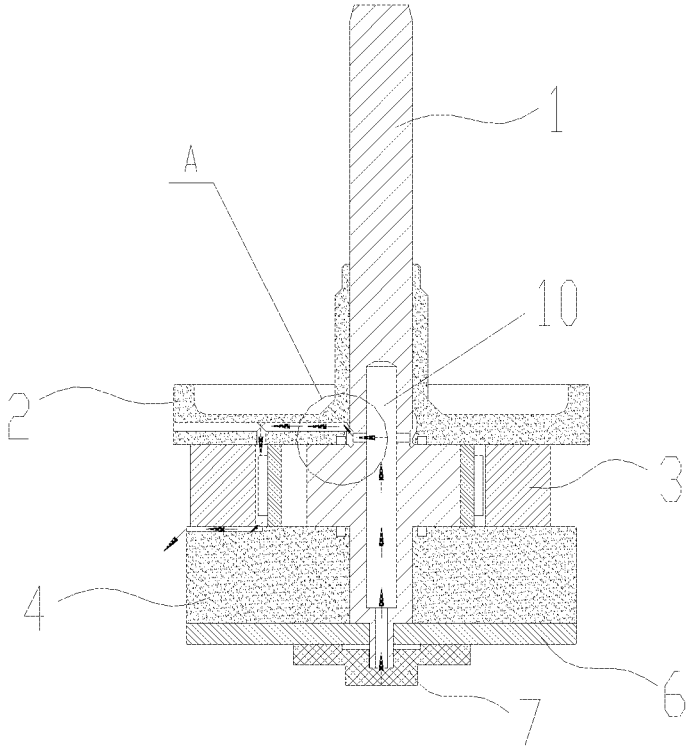
FIG. 2 shows a schematic cross-sectional view of a longitudinal section in FIG. 1.
Figure 3:
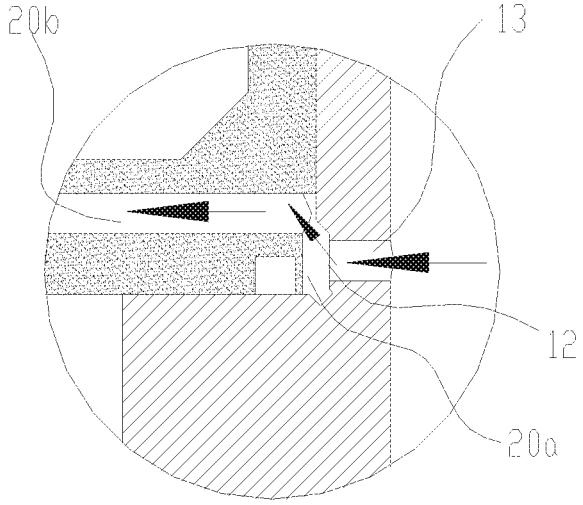
FIG. 3 shows a schematic view of an enlarged structure of a portion A in FIG. 2.
Figure 4:
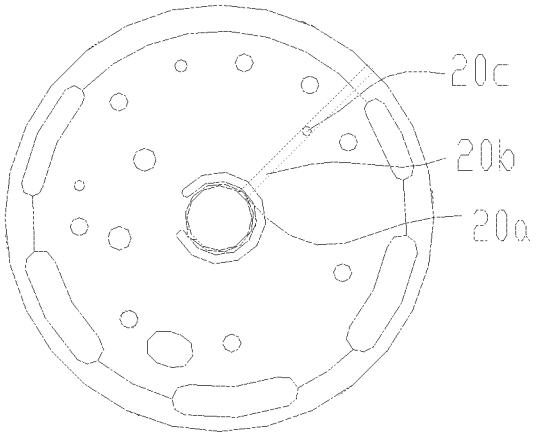
FIG. 4 shows a schematic view of a top view structure of an upper flange in FIG. 1.

As shown in FIGS. 2-4, in some embodiments, the upper oil reservoir 20 includes:

a straight oil groove 20*a* in communication with the spindle oil hole 10;

an oil inlet hole 20*c* in communication with the rolling body 33;

an oil inlet passage 20*b* with one end in communication with the straight oil groove 20*a* and the other end in communication with the oil inlet hole 20*c*.

This is a specific structural form of the upper oil reservoir provided in the upper flange in some embodiments of the present disclosure. By means of the straight oil groove, the lubricating oil is guided from the spindle oil hole into the straight oil groove 20*a*, further guided by the oil inlet passage 20*b*, and finally guided into the oil inlet hole 20*c*, and then guided to a position of the rolling body of the rolling bearing, so as to complete the function and effect of lubricating the rolling body of the bearing.

FIG. 1 is a basic structure of a pump body of the compressor. The condition of the oil line is specifically as shown in FIG. 2. The gear oil pump rotates along with the spindle, to force the oil in the oil sump to the spindle center hole. The spindle has an upper end sealed and a lower end provided with a hole. When the lubricating oil guided from the central hole to the height of the upper flange, it is subjected to an oil pressure to flow to the spindle radial oil hole, and then flow to a small oil storage space formed by the spindle escape and the straight oil groove of the upper flange (as shown in a partially enlarged view of FIG. 3).

Since the oil is sucked in a steady stream during operation of the compressor, when the small oil storage space is full, the lubricating oil is guided into the straight oil groove of the upper flange, through the oil inlet passage 20*b*, and then to the oil inlet hole 20*c*, specifically as shown in FIG. 4. Since the upper flange does not rotate along with the spindle, but the rolling body of the rolling bearing rotates along with the spindle and performs self-rotation, the oil is continuously supplied to the rolling body at the fixed position of the oil inlet provided in the upper flange, so as to achieving a lubricating effect for each of the rolling bodies.

In some embodiments, the straight oil groove 20*a* is provided radially inward of the upper flange 2 and extends along an axial direction of the upper flange 2. The oil inlet passage 20*b* extends along a radial direction of the upper flange 2, and the oil inlet hole 20*c* extends along an axial direction of the upper flange 2.

This is a further structural form of the straight oil groove 20*a*, the oil inlet passage 20*b* and the oil inlet hole 20*c* according to some embodiments of the present disclosure, which completes the function of conveying and guiding the lubricating oil from the spindle oil hole to the rolling body of the rolling bearing. Especially, the oil inlet hole 20*c* extends along an axial direction of the upper flange, so that the lubricating oil is guided to the rolling body from top to bottom in a vertical direction, thereby effectively utilizing the gravitational effect to reduce the flowing power used to pump the oil and improving the conveying efficiency of the lubricating oil.

As shown in FIGS. 4-7, in some embodiments, on a cross section of the upper flange 2, the straight oil groove 20*a* is an annular oil groove or an arc-shaped oil groove. This is a structural form of the straight oil groove according to some embodiments of the present disclosure, which is correspondingly provided to be the annular oil groove or the arc-shaped oil groove according to a cylinder shape of the spindle, so that the lubricating oil is guided from a plurality of circumferential positions of the spindle to the straight oil groove 20*a*. Moreover, the annular oil groove is provided to communicate a plurality of oil inlet passage 20*b*, such that the structure is simple and practical.

In some embodiments, there are two or more oil inlet passages 20*b*, which are distributed along a circumference of the upper flange 2;

Each of the oil inlet passages 20*b* connects to one of the oil inlet holes 20*c*, and two or more of the oil inlet passages 20*b* communicate with one of the straight oil grooves 20*a*, or each of the oil inlet passages 20*b* connects to one of the straight oil grooves 20*a*.

This is a form of the oil inlet passages 20*b* according to some embodiments of the present disclosure by two or more of the oil inlet passages 20*b* provided, so that it is adapted to radially guide and convey the oil along different circumferential directions of the upper flange, thereby raising a flow rate of the conveyed oil to increase an amount of the conveyed oil, improving the lubricating and cooling effect of the rolling body of the bearing, and improving the operational reliability and stability of the compressor, and allowing the compressor to operate at a higher frequency and a higher rotational speed.

Embodiment 2

Figure 6:
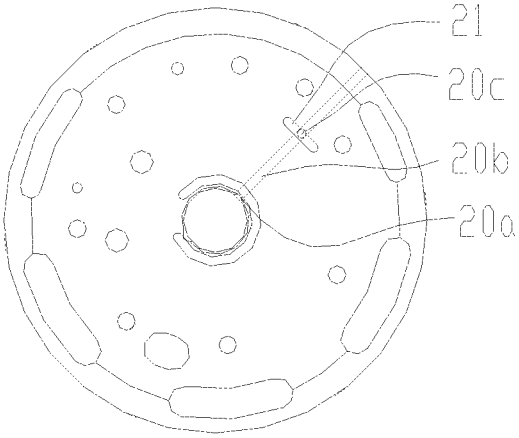
FIG. 6 shows a schematic view of a top view structure of an upper flange in FIG. 4, in which an upper oil reservoir according to a first embodiment is provided.
Figure 7:
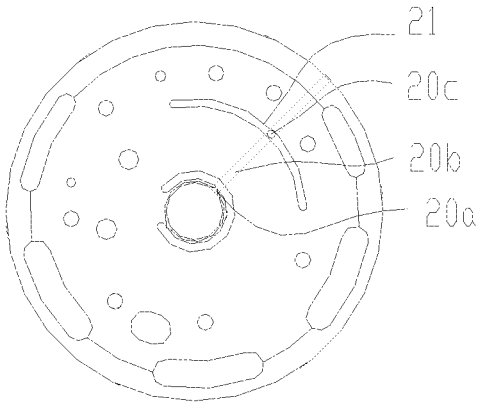
FIG. 7 shows a schematic view of a top view structure of an upper flange in FIG. 4, in which an upper oil reservoir according to a second embodiment is provided.

The present embodiment is a further improvement made on the basis of the embodiment 1. As shown in FIGS. 6-7, in some embodiments, there further includes an upper oil reservoir 21 disposed on the upper flange 2, wherein the upper oil reservoir 21 communicates with the oil inlet hole 20*c* and the oil inlet passage 20*b*.

By means of the upper oil reservoir provided at the above-described position, the oil in the oil inlet passage is guided into the upper oil reservoir for storage before guiding into the oil inlet passage, thereby achieving the oil storage effect during an excessively large amount of oil, and releasing the lubricating oil through the oil reservoir during an excessively small amount of oil, to achieve a favorable lubricating and cooling effect of the rolling bearing and improve the performance of the compressor.

In some embodiments, the upper oil reservoir 21 is located above an axial direction of the oil inlet hole 20*c* and extends in a circumferential direction of the upper flange 2. It is adapted to change the direction of the oil that is about to enter the oil inlet hole 20*c* to enter the upper oil reservoir to complete the oil storage effect. The upper oil reservoir is a straight section groove, as shown in FIG. 6. The upper oil reservoir is a curved section groove, as shown in FIG. 7, the upper oil reservoir in FIG. 7 has a cross-sectional area greater than that in FIG. 6.

Embodiment 3

Figure 15:
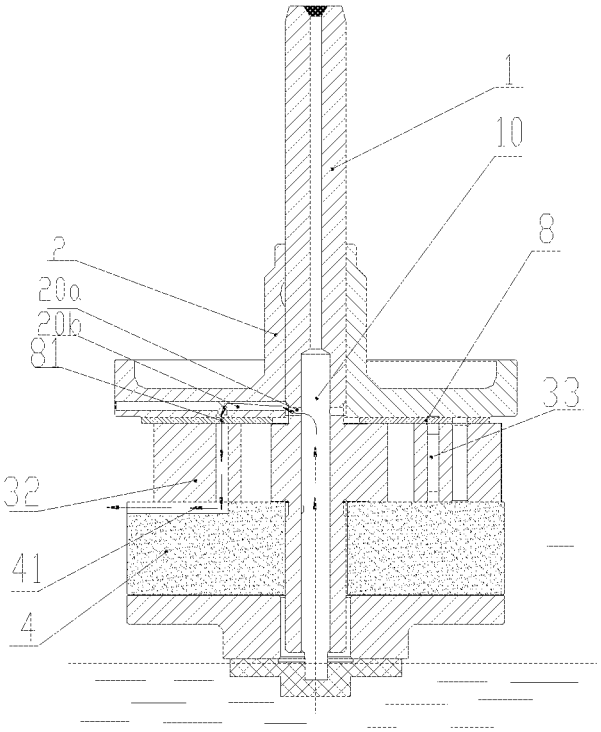
FIG. 15 shows a cross-sectional schematic view of a front of a compressor according to some embodiments of the present disclosure, in which a gasket is provided.
Figure 16:
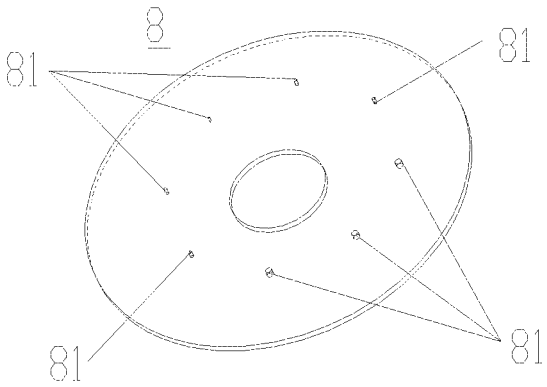
FIG. 16 shows a schematic view of a three-dimensional structure of a gasket in FIG. 15.

As shown in FIGS. 15-16, this embodiment is a further improvement made on the basis of the embodiment 1 and/or 2. In some embodiments, a gasket 8 is further provided between the upper flange 2 and the rolling bearing 3, and along an axial direction of the spindle, the gasket 8 is provided with a plurality of oil guiding holes 81, the plurality of oil guiding holes 81 are arranged along a circumferential direction of the spindle, and communicate the oil inlet hole 20*c* with the rolling body 33.

Before the gasket is added, the lubricating oil directly enters the rolling body 33 of the bearing cavity through the oil inlet hole 20*c* of the upper flange. In principle, the oil is supplied from one point to the entire bearing cavity, so that there is a relatively fixed position for oil supply. Although the cone is rotary, there is a great temperature difference in the oil for an interior of the entire bearing cavity. After the gasket is added, the oil supplying within a range of 360° to the entire bearing cavity is realized, and different hole diameters are set as needed to achieve lubrication of the rolling body. After there is a gasket, it is adapted to make the lubrication and cooling of the rolling body more adequate. In addition, the gasket is adapted to improve a wear condition of the cone of the rolling bearing and an end surface of the upper flange.

In some embodiments, at least two of the plurality of oil guiding holes 81 have different diameters, and the oil guiding holes 81 closer to the exhaust hole of the rolling bearing 3 has a larger diameter than the oil guiding holes 81 closer to the intake hole of the rolling bearing 3.

The gasket is mainly provided with oil guiding holes 81 of different diameters. The size of the oil guiding holes is set according to the needs of lubrication. In the vicinity on an exhaust side (exhaust hole), the rolling body withstands a maximum pressure under the effect of a differential pressure of the cone, and needs much more lubricating oil, so that the oil holes here have to be designed in a larger diameter. However, the oil guiding holes immediately opposite to the oil inlet hole 20*c* of the upper flange are not subjected to a great force since they are located on a suction side of the compressor, there is less amount of oil required here, so that the oil holes have to be designed in a smaller diameter.

It optionally includes oil guiding holes having three diameters: $\varphi c<\varphi b<\varphi a$.

Embodiment 4

The present embodiment is a further improvement made on the basis of the embodiments 1-3. In some embodiments, there further includes a lower flange 4, the lower flange 4 is also provided with a lower oil groove 41 communicating with the rolling body 33. The lower oil groove 41 is configured to guide the oil out of the lower flange 4, or out of the rolling bearing 3. The oil is conveyed and deflected by means of the lower oil groove provided in the lower flange, and the lubricating oil is discharged into the housing of the compressor to realize the recovery and recycling.

Figure 8:
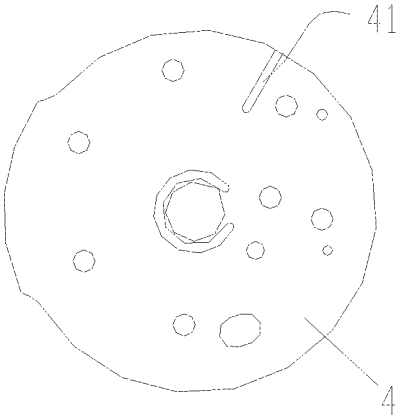
FIG. 8 shows a schematic view of a lower flange of a compressor according to some embodiments of the present disclosure, in which a lower oil groove according to a first embodiment is provided.

Then, after the lubricating oil passes through the rolling body, it flows to the lower flange dues to the effect of own gravity and oil pressure, and concentratively flows to the lower oil groove of the lower flange (as shown in FIG. 8). Since the lower oil groove directly leads to an exterior of the pump body, the oil flows into the oil sump of the housing along with the oil outlet groove on the end surface.

Such solution of a lubricating oil line of the rolling bearing, which communicates the spindle, the upper flange, the rolling bearing and the lower flange, is not only adapted to make the lubricating oil to be recycled in use in the sump of the housing, but also to ensure that the rolling body of the rolling bearing to be adequately lubricated. At the same time, it also adapted to take away the heat generated by friction in this process in time. Such oil line means achieves the effect of adequately lubricating the rolling bearing, thereby reducing the wear of the pump body during the operation of the compressor and enhancing the reliability of the operation thereof.

In some embodiments, the lower oil groove 41 is located below an axial direction of the rolling body 33, and the lower oil groove 41 radially extends to a circumferential end surface of the lower flange 4, such that the oil is guided out of the circumferential end surface. In this way, the oil is directly guided to the circumferential end surface of the lower flange through the lower oil groove, so as to complete the purpose and function of discharging the oil out of the pump body of the compressor and into the sump at the bottom of the housing of the compressor.

In some embodiments, there are two or more lower oil grooves 41, which are distributed at different circumferential positions of the lower flange 4. This is an optional form of the lower oil groove, such that it is adapted to increase a discharge amount of the lubricating oil by two or more lower oil grooves, thereby accelerating the circulation speed of the lubricating oil, and improving the cooling and lubricating rate of the bearing.

Figure 10:
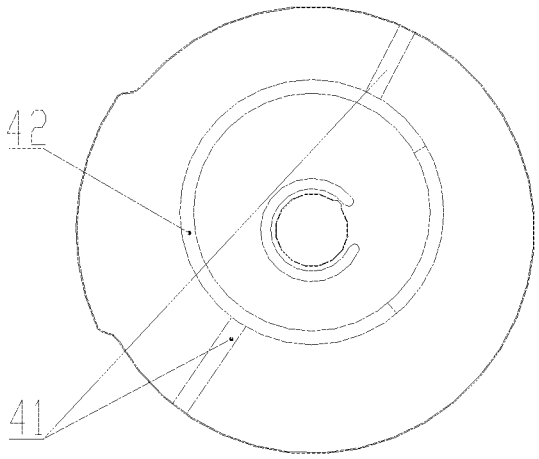
FIG. 10 shows a schematic view of a lower flange of a compressor according to some embodiments of the present disclosure, in which a lower oil reservoir is provided.

As shown in FIG. 10, in some embodiments, there further includes a lower oil reservoir 42 provided in the lower flange 4, wherein the lower oil reservoir 42 is in communication with the lower oil groove 41. By means of the lower oil reservoir provided at the above-described position, it is adapted to guide the oil into the lower oil reservoir for storage before entering the lower oil groove 41, thereby achieving the oil storage effect during an excessively large amount of oil, and releasing the lubricating oil through the oil reservoir during an excessively small amount of oil, so as to ensure a favorable lubricating and cooling effect of the rolling bearing and improve the performance of the compressor.

In some embodiments, the lower oil reservoir 42 is an annular structure circumferentially surrounding the spindle 1. This is an optional shape of the lower oil reservoir according to some embodiments of the present disclosure, which enhances the oil storage ability to a greater extent.

Referring to FIGS. 11-15, in in some embodiments, the rolling bearing 3 further includes a bearing cone 31 and a bearing cup 32. The bearing cup 32 is provided with a bearing cup oil groove 321, and the lower oil groove 41 is configured to communicate the rolling body 33 with the bearing cup oil groove 321, such that the oil is discharged from the bearing cup 32 through the bearing cup oil groove 321. There is an enlarged circulation area of the lower oil groove 41 at a position axially opposite to the bearing cup oil groove, so that it is adapted to be used for oil storage.

By providing the bearing cup oil groove in the bearing cup, it is adapted to guide the oil flowing from the lower oil groove of the lower flange to an exterior of the bearing cup, thereby achieving the function of discharging the lubricating oil. This is an alternative with respect to the solution of discharging the oil in the lower flange.

Figure 5:
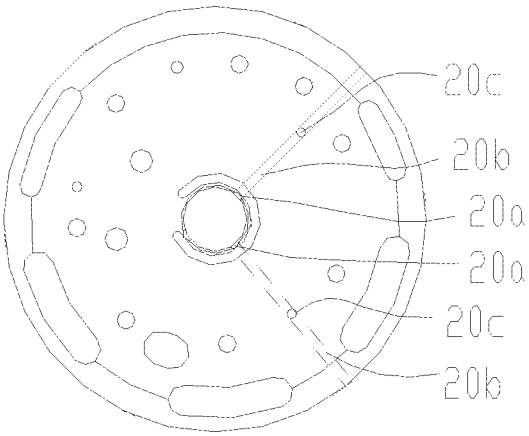
FIG. 5 shows a schematic view of a top view structure of an upper flange according to an alternative embodiment of FIG. 4.

As shown in FIG. 5, in contrast with FIG. 4, for the upper flange, the positions of the oil inlet passage and the oil inlet hole (positions provided at different angles), and the amounts of the oil inlet passages and the oil inlet hole 20*c* are adjustable. In addition, the end surface structure of the upper flange is optionally provided the annular oil reservoirs having different lengths for oil storage, as shown in FIGS. 6, 7.

Figure 9:
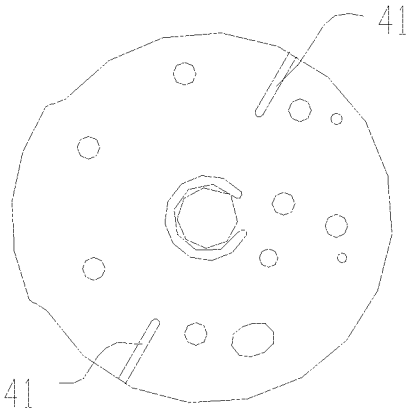
FIG. 9 shows a schematic view of a lower flange of a compressor according to some embodiments of the present disclosure, in which a lower oil groove according to a second embodiment is provided.

As shown in FIG. 9, in contrast with FIG. 8, the positions (grooves provided at different angles) and amounts (one, two or more) of the oil outlet grooves in the end surface of the lower flange are adjustable.

Figure 11:
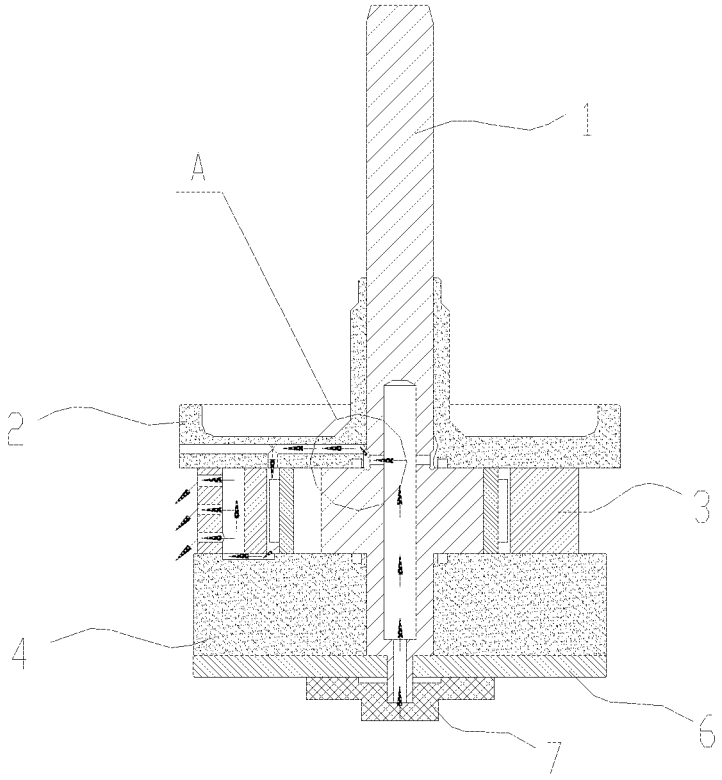
FIG. 11 shows a longitudinal cross-sectional view of a compressor according to some embodiments of the present disclosure, in which a bearing cup oil groove is provided on a bearing cup.
Figure 12:
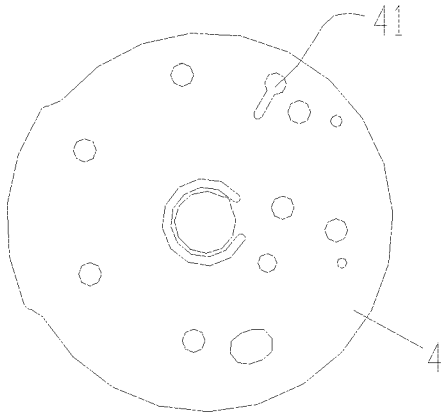
FIG. 12 shows a schematic of top view of a lower flange in FIG. 11.
Figure 13:
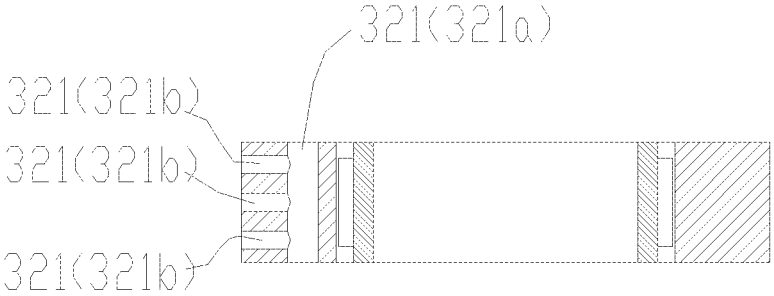
FIG. 13 shows a longitudinal cross-sectional view of a rolling bearing in FIG. 11 according to a first embodiment.
Figure 14:
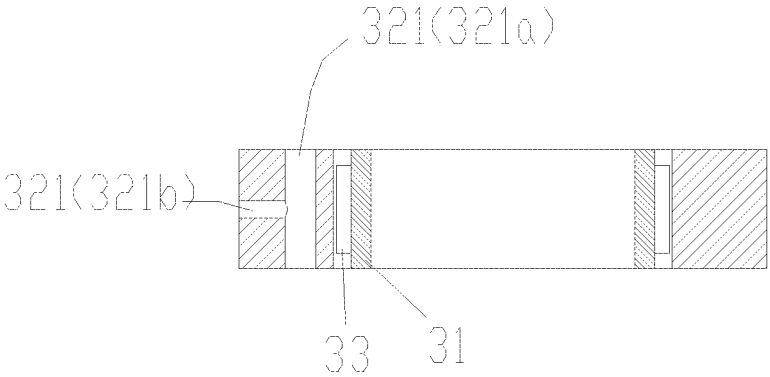
FIG. 14 shows a longitudinal cross-sectional view of a rolling bearing in FIG. 11 according to a second embodiment.

The oil outlet position is optionally raised from the oil outlet hole in the end surface of the lower flange to the lateral hole of the rolling bearing, to replace the lower oil groove of the lower flange. The specific oil line is as shown in FIG. 10, and the lubricating oil in the area of the rolling body flows into the oil reservoir in the end surface of the lower flange (as shown in FIG. 11), and the groove communicates with the through hole which through the upper and lower end surfaces of the rolling bearing (as shown in FIG. 12), such that the lubricating oil flows to the through hole, and afterwards flows out of the radial oil hole 321*b* (one or more) of the rolling bearing into the sump of the housing. Further, as shown in FIG. 13, the lateral hole of the rolling bearing is optionally provided at different height positions. Alternatively, one or more lateral holes of the rolling bearing are provided.

In some embodiments, the bearing cup oil groove 321 includes an axial oil hole 321*a* extending along the axial direction of the bearing cup 32 and at least one radial oil hole 321*b* extending along the radial direction of the bearing cup 32. The axial oil hole 321*a* communicates with the lower oil groove 41, and the radial oil hole 321*b* communicates with the axial oil hole 321*a*, such that the oil is discharged from a circumferential surface of the bearing cup 32 through the radial oil hole 321*b*.

This is a specific structural form of the bearing cup oil groove provided in the bearing cup according to some embodiments of the present disclosure, such that the oil in the lower oil groove is axially sucked through the axial oil hole, and guided into the radial oil hole, and is discharged from the outer circumferential surface of the bearing cup, thereby achieving the function and purpose of discharging the lubricating oil.

In some embodiments, the lower oil groove 41 extends along a radial direction of the lower flange 4;

And/or, there are a plurality of said radial oil holes 321*b*, which are arranged in parallel, and extending along a radial direction of the bearing cup 32.

This is an optional extending direction of the lower oil groove in the oil line structure according to some embodiments of the present disclosure, as well as a plurality provided manners of the radial oil grooves, such that it is adapted to radially guide the oil in the lower flange, and radially discharge the oil in the bearing cup.

In some embodiments, the spindle oil hole 10 includes a spindle radial oil hole 13 provided in the radially outside and along a radial direction. By means of the spindle radial oil hole, the oil in the spindle oil hole is guided along a radial direction into the upper oil groove 20, thereby achieving the function of guiding and outputting the lubricating oil.

In some embodiments of the present disclosure provides a structure for lubricating a rolling bearing of a compressor. According to the characteristics of pumping the oil in the compressor, different oil holes and upper oil grooves are provided in the upper flange, the lower flange and the rolling bearing, such that the rolling bearing communicates the oil lines of the upper and lower flanges, to achieve the effect of adequately lubricating the rolling bearing, thereby reducing the wear of the pump body during operation of the compressor, and enhancing the operational reliability thereof. In addition, such lubrication manner has the advantages of simple structure and convenient machining. It ensures the degree of lubricating the bearing of the pump body of the compressor, thereby effectively solving the problems of wear and heat of the rolling bearing, and improving the reliability and energy efficiency of the compressor.

Different holes and grooves are provided inside the upper flange to communicate with the oil outlet hole in the spindle of the pump body and an upper gap area in the rolling body of the rolling bearing, and communicate with the lower gap area in the rolling body at a groove provided in the lower flange, such that the four partial oil lines are in communication (since the rolling body between the bearing cup and the bearing cone has a height less than that of the bearing, there is a gap between the rolling body and the upper and lower end surfaces, wherein the gap between the rolling body and the upper end surface of the bearing is an upper gap area of the rolling body, and the gap between the rolling body and the lower end surface of the bearing is a lower gap area of the rolling body). Accordingly, it is adapted to ensure that there is lubricating oil flowing through the rolling body portion of the rolling bearing, which not only lubricates the rolling bearing, but also takes away the heat generated by rolling friction in time, and reduces the power consumption during operation of the compressor, thereby improving the energy efficiency of the compressor itself.

Some embodiments of the present disclosure provide a compressor including the aforementioned oil line structure of the compressor. The upper flange is provided with an upper oil reservoir in communication with the spindle oil hole, so as to guide the oil into the rolling body to lubricate the same, thereby enabling to effectively guide the oil in the spindle oil hole of the compressor into a site of the rolling body of the rolling bearing through the upper flange, and lubricate and cool the same. In this way, the heat generated by friction of the rolling body is discharged in time, so as to prevent a temperature rise in the bearing and reduce the wear, thereby improving the energy efficiency value of the compressor and ensuring normal operation of the compressor.

It is adapted to guide the oil from top to bottom into the rolling body of the rolling bearing by gravity, thereby ensuring sufficiently lubricating oil in the rolling bearing and ensuring normal operation of the compressor.

In some embodiments, the compressor is a rotary vane compressor. This is an optional structural form of the compressor according to the present disclosure.

The foregoing descriptions are only the preferred embodiments of the present disclosure, but do not serve to limit the present disclosure. Any amendment, equivalent replacement, improvement, and the like made within the spirit and principles of the present disclosure should all be contained within the protection scope of the present disclosure. The foregoing descriptions are only preferred embodiments of the present disclosure. It should be noted that those skilled in the art may also make several improvements and modifications without departing from the technical principles of the present disclosure, which modifications and refinements are also considered to be the protection scope of the present application.

The invention claimed is:

1. A compressor comprising an oil line structure, the oil line structure comprising:

a spindle, internally provided with a spindle oil hole;

an upper flange, provided with an upper oil groove;

a rolling bearing, wherein an interior of the rolling bearing encloses a cylinder cavity for performing compression, and the rolling bearing comprises a rolling body; and a lower flange, provided with a lower oil groove in communication with the rolling body;

wherein the upper flange is located above the rolling bearing in an axial direction of the spindle, the lower flange is located below the rolling bearing in the axial direction of the spindle, the upper oil groove is in communication with the spindle oil hole to guide an oil into the rolling body so as to lubricate the same and the lower oil groove is configured to guide the oil out of the lower flange or guide the oil out of the rolling bearing;

wherein the rolling bearing comprises a bearing cone and a bearing cup, the bearing cup is provided with a bearing cup oil groove, and the lower oil groove communicates the rolling body with the bearing cup oil groove to discharge the oil from the bearing cup through the bearing cup oil groove.

2. The compressor according to claim 1, wherein the upper oil groove comprises:

a straight oil groove in communication with the spindle oil hole;

an oil inlet hole in communication with the rolling body;

an oil inlet passage with one end in communication with the straight oil groove and the other end in communication with the inlet hole.

3. The compressor according to claim 2, wherein the straight oil groove is provided on a radially inner side of the upper flange and extends along an axial direction of the upper flange; the oil inlet passage extends along a radial direction of the upper flange, and the oil inlet hole extends along the axial direction of the upper flange.

4. The compressor according to claim 3, wherein in a cross section of the upper flange, the straight oil groove is an annular oil groove or an arc-shaped oil groove.

5. The compressor according to claim 2, wherein two or more oil inlet passages and two or more oil inlet holes are arranged along a circumference of the upper flange;

each of the oil inlet passages is in communication with respective ones of the oil inlet holes respectively, and the two or more oil inlet passages are in communication with the straight oil groove, or further comprising two or more straight oil grooves, wherein each of the oil inlet passages is in communication with respective ones of the straight oil grooves respectively.

6. The compressor according to claim 2, further comprising an upper oil reservoir disposed on the upper flange, wherein the upper oil reservoir communicates with the oil inlet hole and the oil inlet passage.

7. The compressor according to claim 6, wherein the upper oil reservoir is located above the oil inlet hole in an axial direction of the oil inlet hole and extends in a circumferential direction of the upper flange.

8. The compressor according to claim 2, wherein a gasket is provided between the upper flange and the rolling bearing, and along the axial direction of the spindle, the gasket is provided with a plurality of oil guiding holes, the plurality of oil guiding holes are arranged along a circumferential direction of the spindle, and communicate the oil inlet hole with the rolling body.

9. The compressor according to claim 8, wherein at least two of the plurality of oil guiding holes have different diameters, and the oil guiding hole closer to an exhaust hole of the rolling bearing has a larger diameter than the oil guiding hole closer to an intake hole of the rolling bearing.

10. The compressor according to claim 1, further comprising a lower oil reservoir provided in the lower flange, wherein the lower oil reservoir is in communication with the lower oil groove.

11. The compressor according to claim 10, wherein the lower oil reservoir is an annular structure circumferentially surrounding the spindle.

12. The compressor according to claim 1, wherein the bearing cup oil groove comprises an axial oil hole extending along an axial direction of the bearing cup and at least one radial oil hole extending along a radial direction of the bearing cup, the axial oil hole communicates with the lower oil groove, and the at least one radial oil hole communicates with the axial oil hole, such that the oil is discharged from a circumferential surface of the bearing cup through the radial oil hole.

13. The compressor according to claim 12, wherein the lower oil groove extends along a radial direction of the lower flange;

or, there are a plurality of the radial oil holes arranged in parallel, and extending along the radial direction of the bearing cup.

14. The compressor according to claim 1, wherein the spindle oil hole comprises a spindle radial oil hole provided inside the spindle and along a radial direction of the spindle.

15. An air-conditioner, comprising the compressor comprising the oil line structure according to claim 1.

* * * * *